United States Patent [19]

Arregui et al.

[11] 4,421,073

[45] Dec. 20, 1983

[54] ROTATING CYLINDER INTERNAL COMBUSTION ENGINE

[76] Inventors: Manuel Arregui, P.O. Box 495-8, Prince Albert, Saskatchewan Province, Canada; Rafael Diaz, 5 St. Charles St., Ile Bizard, Quebec Province, Canada, H9C 1L3; Vicente Gamon, 25 - 1° D.; Javier Yarza, 4 - 3°, both of Irun S.S., Spain

[21] Appl. No.: 330,080

[22] Filed: Dec. 14, 1981

[51] Int. Cl.[3] ..... F02B 57/08

[52] U.S. Cl. ..... 123/43 R; 123/44 D

[58] Field of Search ..... 123/43 R, 44 R, 44 C, 123/44 D; 91/491

[56] References Cited

U.S. PATENT DOCUMENTS

| | | | |
|---|---|---|---|
| 2,109,185 | 2/1938 | Thompson | 123/44 D |
| 3,865,093 | 2/1975 | Rodriguez | 123/44 D |
| 3,921,601 | 11/1975 | Maoz . | |
| 3,991,728 | 11/1976 | Vittert | 123/44 D |

FOREIGN PATENT DOCUMENTS

| | | | |
|---|---|---|---|
| 188928 | 3/1919 | Canada . | |
| 196535 | 1/1920 | Canada . | |
| 138036 | 8/1923 | Canada . | |
| 344159 | 8/1934 | Canada . | |
| 393537 | 12/1940 | Canada . | |
| 2153946 | 3/1973 | Fed. Rep. of Germany | 123/44 D |

*Primary Examiner*—Michael Koczo
*Assistant Examiner*—Peggy A. Loiacano

[57] ABSTRACT

An internal combustion rotary engine of the type comprising a rotor, an output shaft eccentric to the rotor, pistons reciprocable in and out in the rotor relative to its axis of rotation, and piston rods connecting the pistons to the shaft. This rotary engine is characterized by the absence of dead points in the course of the pistons and piston rods, by connection of the piston rods to the output shaft to maintain substantial leverage for the action of the pistons on the output shaft, and by a simple connection between the output shaft and the rotor to concurrently synchronize them.

8 Claims, 7 Drawing Figures

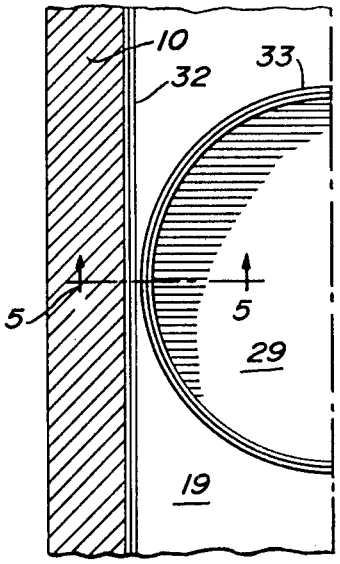
FIG. 4
FIG. 5
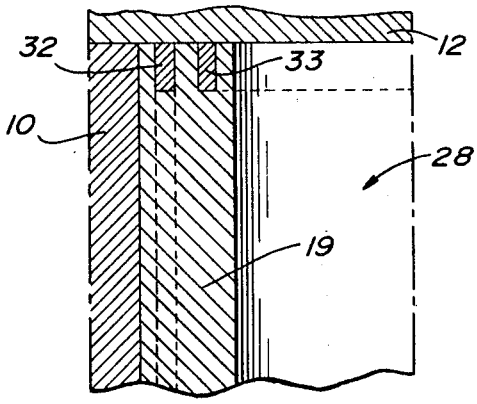
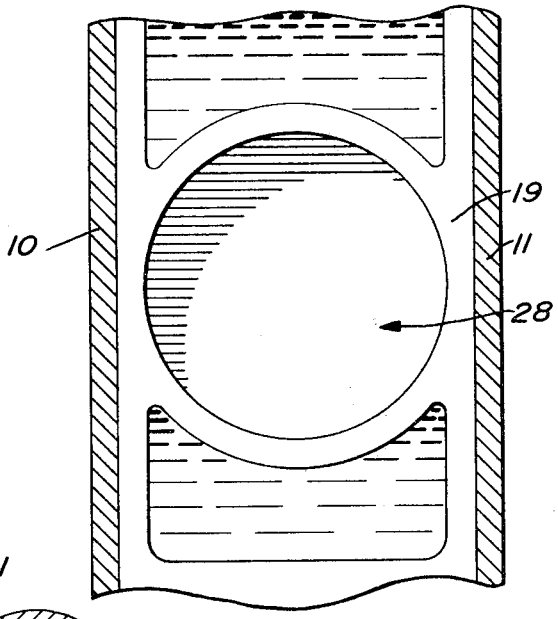
FIG. 6
FIG. 7
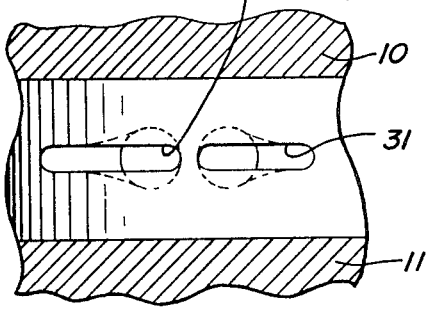

ROTATING CYLINDER INTERNAL COMBUSTION ENGINE

FIELD OF THE INVENTION

This invention relates to an internal combustion rotary engine of the type including pistons reciprocable in a rotor in an out relative to its axis of rotation.

DESCRIPTION OF THE PRIOR ART

In the internal combustion rotary engine of the above type that have been conceived up to now, the relative reciprocation of the pistons and displacement of the piston rods has been the major concern and gave rise to many distinct concepts to produce a satisfactory kinematic arrangement. The concepts or solutions proposed so far are characterized by one or more of the following relative disadvantages: the existence of a lower and an upper dead points as in a conventional piston engine, the existence of a complex assembly to produce reciprocation of the pistons, and lack of simplicity.

SUMMARY OF THE INVENTION

It is a general object of the present invention to provide an internal combustion rotary engine of the above type that avoids the above mentioned disadvantages.

It is a more specific object of the present invention to provide an internal combustion rotary engine of the above type in which there is no dead points in the displacement of the pistons and piston rods and the connection of the latter to the output shaft will maintain leverage for the action of the pistons on the shaft.

It is another object of the present invention to provide an internal combustion rotary engine of the above type in which a simple coupling arrangement is provided between the output shaft and the rotor to concurrently synchronize the same.

It is a further object of the present invention to provide an internal combustion rotary engine of the above type in which the piston rods and output shaft are connected to produce maximum crank leverage during the power stroke of the pistons.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings; in which:

FIG. 4 is a cross sectional view taken transversely at the end of a cylinder, as seen along line 4—4 in FIG. 2;

FIG. 5 is a cross sectional view as seen along line 5—5 in FIG. 4 and particularly showing details of the seals attached to the rotor;

FIG. 6 is a cross sectional view as seen along line 6—6 in FIG. 2 showing details of the rotor; and FIG. 7 is a cross sectional view with the rotor removed and as seen along line 7—7 in FIG. 1.

Figure 1:
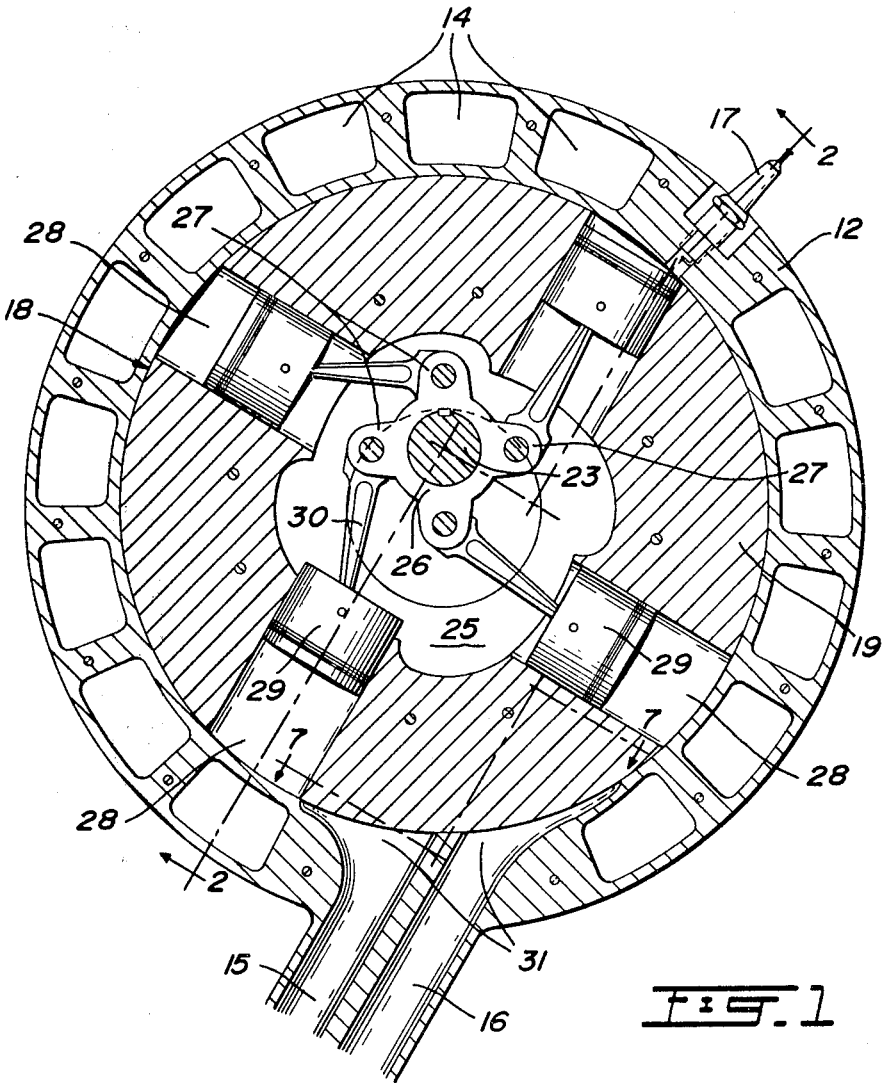
FIG. 1 is a transverse section through an internal combustion rotary engine according to the present invention.

The illustrated internal combustion rotary engine comprises a casing formed of a pair of axially spaced apart end plates 10, 11 and an intermediate ring 12 operatively secured as shown to enclose a cylindrical rotor chamber. The end plates 10, 11 are formed each with an annular void or space 13. The intermediate ring 12 is also formed with a plurality of voids or spaces 14 serially arranged around the ring. A gas inlet 15 and an exhaust outlet 16 extend through the intermediate ring 12 to provide communication with the cylindrical rotor chamber. A spark plug 17 extends through the intermediate ring 12.

A rotor 18 is rotatably mounted in the cylindrical rotor chamber formed by the casing end plates 10, 11 and intermediate ring 12. The rotor 18 includes an annular body 19 having a cylindrical outer surface matching the cylindrical inner surface formed by the intermediate ring 12. The rotor 18 includes a pair of axially opposite rotor end plates 20, 21 secured against the axially opposite faces of the annular body 19 to bodily rotate with it. The rotor end plates 20, 21 are rotatively mounted on the inside of the casing end plates 10, 11 respectively by ball bearings 22. A straight output shaft 23 is rotatively carried through the casing by sleeve bearings 24 mounted in the end plates 10,11 of the casing.

As seen best in FIG. 1, the axis of the shaft 23 is laterally offset relative to the rotational axis of rotor 18.

Figure 2:
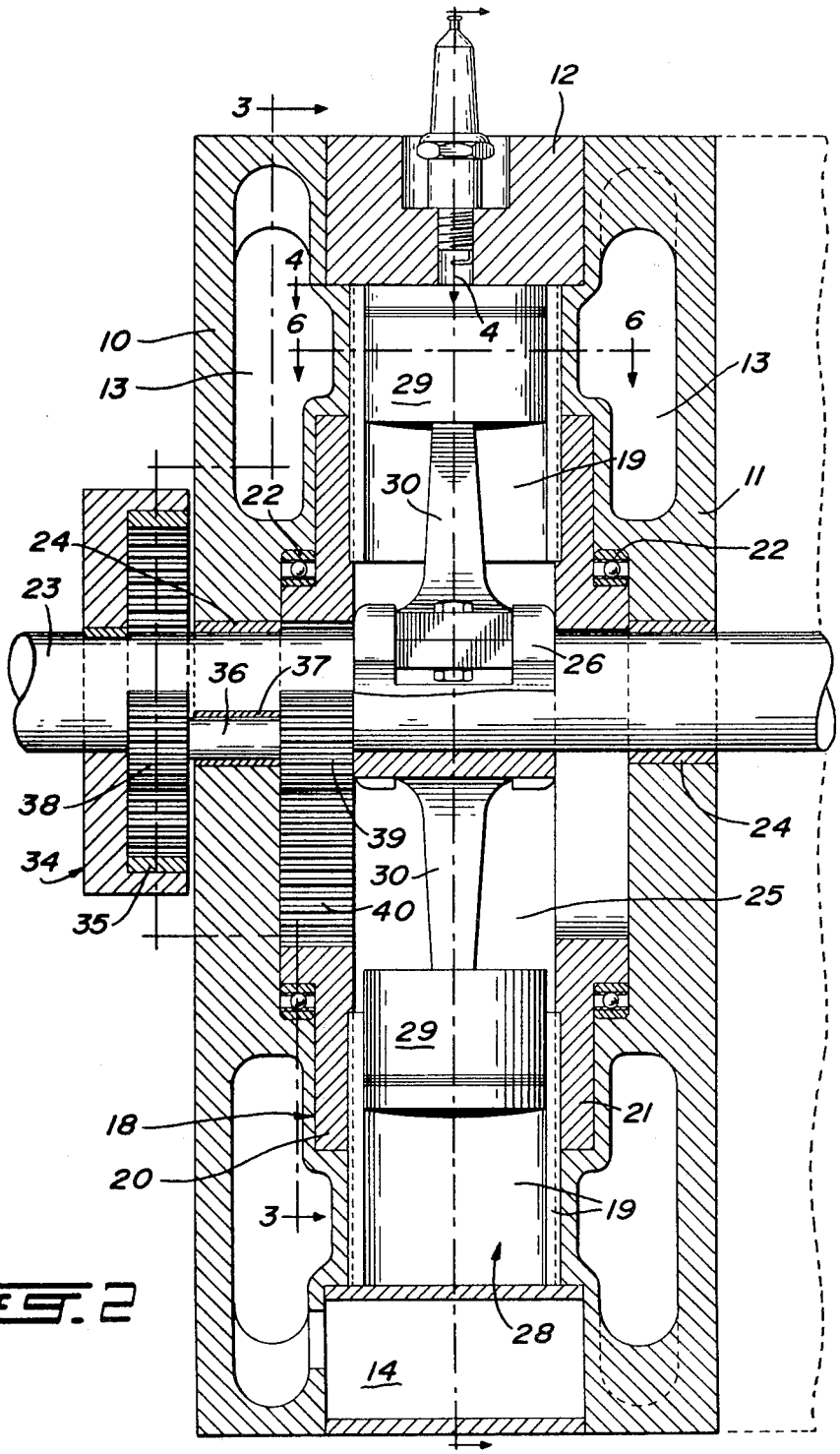
FIG. 2 is a cross sectional view of the same rotary engine, as seen along line 2—2 in FIG. 1.
Figure 3:
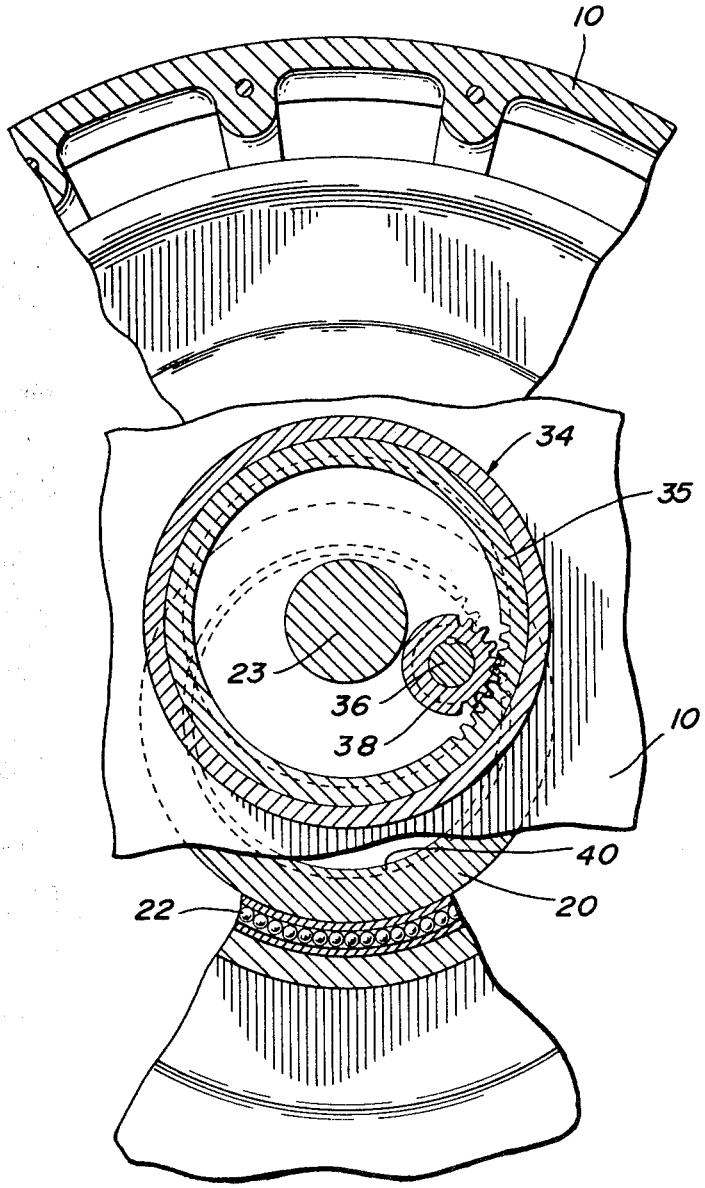
FIG. 3 is a cross sectional view as seen along line 3—3 in FIG. 2.

The annular body 19 of the rotor 18 forms a central chamber 25 in which a star wheel 26 is keyed on the crank shaft 23 for bodily rotation with it. The star wheel 26 is formed with four bosses 27 radially projecting around it. The annular body 19 of the rotor 18 is formed with piston chambers 28 that axially extend in it from the central chamber 25 to its cylindrical outer surface. Chambers 25 and 28 fully communicate. The axis of each piston chamber 28 is parallel to a radius of rotor 18 and preferably spaced relative to said radius in the direction of rotation of rotor 18. A piston 29 of conventional construction, normally of cylindrical shape, is reciprocatively mounted in each piston chamber 28. A connecting rod 30 is pivotally connected to each piston 29 and to a corresponding boss 27 of the star wheel 26, as best shown in FIG. 1. The connecting points of connecting rod 30 to bosses 27 are uniformly radially spaced from the axis of output shaft 23. It must be noted that each connecting rod 30 is connected to its corresponding boss 27 of the star wheel to give leverage for the action of the corresponding piston at any position of the piston, and in particular, when the piston is at the firing position in registry with the spark plug 17, as shown at the top of FIGS. 1 and 2. That leverage is arranged to be maximum during the power stroke of the piston. This is done by proper predetermined angular correlation between the star wheel 26 and the rotor 18. More specifically, the connecting points of connecting rods 30 to bosses 27 are angularly advanced in the direction of rotor rotation relative to virtual radial line connections between the axis of output shaft 23 and the pivotal connection of connecting rods 30 to pistons 29.

As shown in FIG. 7, the gas inlet 15 and exhaust outlet 16 are each formed with a circumferentially flaring portion 31 angularly arranged and extended for timely gas intake and exhaust upon angular registry of the piston chambers with them in response to clockwise rotation of the rotor 18, as seen in FIG. 1.

A seal 32 is provided along each lateral edge of the cylindrical outer surface of the annular body 19 of the rotor. A circular seal 33 is also provided around the outer end of each piston chamber 28.

A drive train is provided to concurrently synchronize the rotation of the output shaft 23 and rotor 18 that is, the drive train causes rotation of shaft 23 and rotor 18 at the same speed and in the same direction of rotation. That drive train includes an annular gear carrying cap 34 keyed on the output shaft to bodily rotate with it against the outside of the casing end plate 10. A ring gear 35 is fixedly secured in the annular cap 34 to rotate with it. An auxiliary shaft 36 is rotatably carried by the casing end plate 10 in a sleeve bearing 37. The auxiliary shaft 36 extends parallel to the output shaft 23 and has a pair of pinion gears 38, 39 fixedly secured on its opposite ends for bodily rotation with it. The rotor end plate 20 is formed with a ring gear 40. The pinion gears 38 and 39 mesh with the ring gears 35 and 40 respectively and thus transmit the rotation of the cap 34 and thus of the shaft 23 to the rotor 18.

As the rotor 18 and the output shaft 23 concurrently rotate, the pistons 29 reciprocate in their piston chamber 28 due to the offset between the axes of the output shaft and the rotor. That reciprocation of the pistons is synchronized to achieve firing in registry with the spark plug 17 and expansion clockwise from there to the exhaust outlet 16. From the gas inlet 15, still clockwise, to the spark plug 17, the gas is admitted in the piston chamber and compressed until its firing by the spark plug.

What we claim is:

1. An internal combustion rotary engine comprising: a casing defining a cylindrical chamber; a rotor rotatively mounted in the cylindrical chamber, defining a rotor axis, a central chamber and piston chambers communicating with said central chamber, each piston chamber having its longitudinal axis parallel to a radius of said rotor, an output shaft rotatably carried through the casing, freely extending in the central chamber of the rotor, and radially offset relative to the rotor axis; pistons operatively reciprocable in the piston chambers; connecting rods pivotally connected to the pistons and to connecting points carried by and uniformly radially spaced from the axis of said output shaft, bodily rotatable therewith, and angularly advanced in the direction of rotor rotation relative to virtual radial line connections between the axis of the output shaft and the pivotal connections of the connecting rods to the pistons; and a drive train drivingly coupling the output shaft to the rotor and operatively transmitting rotation to the latter and producing concurrent and synchronous rotation of the rotor with the output shaft.

2. An internal combustion rotary engine as defined in claim 1, further including a star-wheel member fixedly secured to the output shaft in the central chamber and including lobes spaced apart around the output shaft and operatively forming said connecting points.

3. An internal combustion rotary engine as defined in claim 2, wherein the rotor includes an annular body and said piston chambers are of cylindrical shape and are formed in said rotor body, and opposite end plates fixedly secured to the annular rotor body cooperatively forming therewith the central chamber and rotatively carrying the annular rotor body in the casing.

4. An internal combustion rotary engine as defined in claim 1, wherein the drive train includes an auxiliary shaft rotatably carried by said casing and parallel to said output shaft, a first pair of gears operatively connecting the output shaft to the auxiliary shaft, and a second pair of gears operatively connecting the auxiliary shaft to the rotor, whereby the rotation of the output shaft and of the rotor are concurrently synchronized.

5. An internal combustion rotary engine as defined in claim 1, wherein the drive train includes an auxiliary shaft rotatably carried by said casing and parallel to said output shaft, an annular gear carrying cap mounted on the output shaft, bodily rotatable therewith adjacent one axial face of the casing, a first gear bodily rotatable within the cap and the output shaft, the auxiliary shaft including a pair of pinion gears fixedly secured thereon for bodily rotation therewith, and the rotor including a second ring gear bodily rotatable therewith, said pinion gears meshing with said first and second ring gears, whereby the rotation of the output shaft and the rotor are concurrently synchronized.

6. An internal combustion rotary engine as defined in claim 5, further including: a starwheel fixedly secured to the output shaft in the central chamber and including lobes spaced apart around the shaft and operatively forming said connecting points; the rotor including an annular rotor body, axially opposite end plates fixedly secured to the annular rotor body, cooperatively forming therewith the central chamber, and rotatively carrying the annular rotor body in the casing; said piston chambers being of cylindrical shape and formed in the annular rotor body.

7. An internal combustion rotary engine as defined in claim 1, wherein the longitudinal axis of each piston chamber is spaced from said axis of said rotor in the direction of rotor rotation.

8. An internal combustion rotary engine as defined in claim 1, wherein said cylindrical chamber of said casing has an inner cylindrical surface and said rotor has a peripheral outer cylindrical surface, each piston chamber opening at said peripheral surface of said rotor, a seal carried by said peripheral surface of said rotor and surrounding said piston chamber opening and in slidable engagement with the cylindrical inner surface of said casing chamber, said engine further including exhaust and admission ports in said cylindrical surface of said casing chamber for communication with the respective piston chambers.

* * * * *